US006367237B1

(12) United States Patent
Huss

(10) Patent No.: US 6,367,237 B1
(45) Date of Patent: Apr. 9, 2002

(54) PLAY-FREE AND CENTERING TUBE COUPLING FOR THE SPINDLE OF A TEXTILE MACHINE

(75) Inventor: Dieter Huss, Sehmatal-Cranzahl (DE)

(73) Assignee: Spindelfabrik Neudorf GmbH, Neudorf (DE)

( * ) Notice: Subject to any disclaimer, the term of this patent is extended or adjusted under 35 U.S.C. 154(b) by 0 days.

(21) Appl. No.: 09/602,875

(22) Filed: Jun. 28, 2000

(30) Foreign Application Priority Data

Jun. 29, 1999 (DE) ..... 199 29 582

(51) Int. Cl.[7] ..... D01H 7/08

(52) U.S. Cl. ..... 57/112; 57/92; 57/132; 57/135; 57/406; 384/228

(58) Field of Search ..... 57/132, 135, 406, 57/92, 112; 384/228

(56) References Cited

U.S. PATENT DOCUMENTS

| | | | | |
|---|---|---|---|---|
| 3,065,593 A | * | 11/1962 | Westall et al. | 57/135 |
| 3,691,747 A | * | 9/1972 | Vilanova | 57/130 |
| 3,958,846 A | * | 5/1976 | Donner | 308/149 |
| 4,116,505 A | * | 9/1978 | Stahlecker | 308/187 |
| 4,254,614 A | * | 3/1981 | Miyamoto et al. | 57/58.89 |
| 4,875,334 A | * | 10/1989 | Rajsigl et al. | 57/100 |

FOREIGN PATENT DOCUMENTS

| | | |
|---|---|---|
| DE | 4131498 | 3/1993 |
| DE | 4217381 | 12/1993 |
| DE | 4318027 | 12/1994 |
| DE | 19537762 | 4/1997 |

* cited by examiner

*Primary Examiner*—Andy Falik
(74) *Attorney, Agent, or Firm*—Greenblum & Bernstein P.L.C.

(57) ABSTRACT

Play-free and centering tube coupling for the spindle of a textile machine, which includes at least three driving elements which are centrically arranged to bear against an inner wall of the tube in a tube receptacle connected nonpositively to the spindle shank. The tube receptacle includes a basic body having a thrust piece arranged axially moveably therein and an end piece fixedly connected to the basic body. The driving elements are designed as driving elements and arranged so as to be movable predominantly radially between the basic body and the thrust piece. Guide slopes are in contact with the driving elements and are in the form of a conically designed collar are arranged on the thrust piece, and detaining centrifugal elements displaceable predominantly radially are arranged between the thrust piece and the end piece. At least one of the faces of the thrust piece and of the end piece which are in contact with the detaining centrifugal elements is designed as a guide slope.

23 Claims, 4 Drawing Sheets

PLAY-FREE AND CENTERING TUBE COUPLING FOR THE SPINDLE OF A TEXTILE MACHINE

CROSS-REFERENCE TO RELATED APPLICATIONS

The present application claims priority under 35 U.S.C. §119 of German Patent Application No. 199 29 582.4, filed on Jun. 29, 1999, the disclosure of which is expressly incorporated by reference herein in its entirety.

BACKGROUND OF THE INVENTION

1. Field of the Invention

The invention relates to a play-free and centering tube of a textile machine. Couplings of this type consist of at least three driving elements which are arranged in a tube receptacle connected nonpositively to the spindle shank, the tube coupling being supported centrically type are required in the textile industry, preferably in spinning and twisting mills.

2. Discussion of Background Information

Tube couplings of the generic type have already been developed. Thus, DE 41 31 498 A1 describes the tube coupling for a spinning or twisting spindle, in which movable driving bodies are used, which are pressed against the inner face of the tube as a result of the centrifugal force. They make a nonpositive and/or positive-connection there between the spindle upper part and the tube and thus make it possible to transmit a torque. On account of the low masses of the movable parts, the available centrifugal forces are relatively low, and therefore a reliable drive of the tubes on the spindle upper parts cannot be ensured. Moreover, at low rotational speeds of the spindles, the coupling has an insignificant effect, so that, particularly when the spindle is being braked, the tube slips on the spindle upper part. This has an adverse affect both on the yarn quality and on the wear of the tube.

Furthermore, DE 42 17 381 A1 describes a tube coupling which is likewise designed as a centrifugal coupling. This centrifugal coupling is located in an extension of the drive wharve, and, because of the relatively low driving forces, a sleeve having a profiled inner face is provided. In this solution, the driving action is reinforced in that there is only a very slight dimensional play between the outside diameter of the tube coupling and the inside diameter of the tube.

DE 43 18 027 A1 discloses a tube coupling intended for making a nonpositive connection between the tube and the spindle upper part by means of variously designed driving bodies. Due to the centrifugal forces which arise, the driving bodies are set in wobbling motion, with the result that they are clamped between the spindle upper part; and the tube. The disadvantage of this type of tube coupling is that the tube is not reliably driven centrically to the spindle axis. Another disadvantage is that this nonpositive clamping connection does not come loose easily when the spindle is at a standstill. Furthermore, it may happen that the driving bodies themselves do not assume a centric position to the spindle axis, this being conducive to the development of unbalances. Moreover, the stability of the spindle upper part is weakened due to the receiving bores for the driving bodies.

Finally, DE 195 37 762 A1 describes a technical solution which is to be suitable particularly for spinning tubes with lower yam masses. In this case, considerable acceleration for starting up the spindle is necessary in order to rotate the rotatable ring in the ball guide. This solution is not suitable for bridging pronounced dimensional differences between the tube inside diameter and the outside diameter of the tube coupling. Since the driving bodies fall down as a result of their inherent mass when the spindle is at a standstill, cantering of the tube can no longer be ensured.

The known technical solutions have in common the defect that they do not offer a sufficient safeguard for reliable centering of the bobbin tube relative to the spindle axis and for the simple removal of the wound tubes from the spindle upper parts. As is known, draw-twist tubes are deformed as a result of the winding forces in such a way that, if there is insufficient play between the inside diameter of the tube and the outside diameter of the tube coupling, the firm fit regularly presents problems when the tube is drawn off.

SUMMARY OF THE INVENTION

The object of the invention, therefore, is to overcome the defects of the known prior art and to provide a tube coupling for spinning or twisting spindles which ensures unimpeded functioning even when there are pronounced dimensional differences between the inside diameter of the tube used and the outside diameter of the tube coupling.

Moreover, the technical solution is to ensure that a possible deformation of the tube when the latter is being wound with thread material is riot detrimental to the centric position of the tube to the spindle axis and the reliable drive of the tube by the spindle. It is to become possible, furthermore, to ensure that tube deformation, which is usually to be seen when plastics are used as tube material and because of high thread forces, does not lead to the firm fit of the tube on the spindle when the latter is at a standstill, so that the draw-off of the tube by hand or by means of tube draw-off devices can easily be ensured. The technical solution to be provided will also be distinguished by a simple design and easy assembly.

According to the invention, a play-free and centering tube coupling for the spindle of a textile machine, includes of at least three driving elements which are arranged centrically so as to bear against an inner wall of the tube, in a tube receptacle connected nonpositively to the spindle shank. A basic body of a thrust piece is axially moveably arranged in the tube receptacle and an end piece fixedly connected to the basic body. The driving elements are arranged so as to be movable predominantly radially between the basis basic body and the thrust piece, and guide slopes, which are in contact with the driving elements and are in the form of a conically designed collar are arranged on the thrust piece. Detaining centrifugal elements, which are displaceable predominantly radially, are arranged between the thrust piece and the end piece, and at least one of the faces of the thrust piece and of the end piece, which are in contact with the detaining centrifugal elements, is designed as a guide slope.

According to the aforementioned invention a play-free and centering tube coupling for the spindle of a textile machine includes at least three driving elements which are arranged centrically in a tube receptacle and come to bear nonpositively on the inner wall of the tube. For this purpose, the tube receptacle includes a basic body, of a thrust piece arranged axially movably therein and of an end piece fixedly connected to the basic body. The driving elements are arranged between the basic body and the thrust piece and are designed to be movable predominantly radially. Arranged on the thrust piece is a conically designed collar, of which the parts which are in contact with the driving elements function as guide slopes. Moreover, detaining centrifugal elements displaceable predominantly radially are arranged between the thrust piece and the end piece. Finally, the fundamental design of the tube coupling includes the fact that at least one of the faces of the thrust piece and of the end piece which are in contact with the detaining centrifugal elements is designed as a guide slope. The entire tube coupling therefore consists solely of simple components which can be produced and assembled efficiently. In particular, it fulfills the aim of ensuring that, if required, even those bobbin tubes can be received which are subject to deformations as a result of high thread forces and, if tube couplings known hitherto are used, may cause complications in the necessary removal from the spindle upper part.

By contrast, with the newly developed tube coupling, any desired geometric plays between the outer circumference of the tube coupling and the inside diameter of the nonloaded tube can be selected, so that not only can the manufacture of the tube coupling be carried out in a virtually completely mechanized and automated manner, but the requisite fault-free mechanized or manual attachment and removal of the tubes on the respective textile machine can also take place.

Furthermore, the particular advantage of the proposed tube coupling is that, even when the respective spindle is at a standstill, the tube is centered relative to the spindle axis and, consequently, unbalances, with the resulting consequences for the respective spindle and for the winding of the tube, can be ruled out. This purpose is served by the driving elements, which are uniformly displaced predominantly radially by the axially movable thrust piece via the guide slopes arranged on the latter and, by partially emerging from the receptacles formed on the basic body of the tube coupling, brace the coupling-covering tube against the basic body. When the spindle is in the working state, at the normal rotational speeds, it is not only the driving elements which are pressed outward against the tube inner wall as a result of centrifugal forces which arise, but also the detaining centrifugal elements which are arranged between the thrust piece and the end piece. These reinforce the normal forces which act in any case in the movable thrust piece, with the result that the radial forces on the driving elements are reinforced even further. When the winding of the tube is concluded and the spindle is at a standstill, these reinforcing forces lapse, so that the respective tube can be easily detached from the tube coupling, with only the forces having to be overcome which act on the driving elements as a result of the inherent mass of the thrust piece via the guide slopes arranged on the latter.

There is provision for the difference in dimensions between the outer radius of the basic body and the outer radius of the middle cylindrical part of the thrust piece to have at least the size of the diameter of the spherical driving element.

Alternatively to this, the difference in dimensions between the outer radius of the basic body and the outer radius of the middle cylindrical part of the thrust piece amounts at least to the overall dimension of the spherical part of the driving element, together with the attached cap-shaped part of the driving element.

This ensures that, if required, the driving elements may be arranged completely within the outside diameter of the basic body of the tube coupling, this being conducive to the easy attachment of the tube onto the tube coupling and to removal from the latter.

In a particular embodiment of the invention, therefore, the driving elements are designed as balls or as caps in conjunction with inner balls. In the last-mentioned design variant, there is consequently the possibility of having the capability of making area contacts between the tube coupling and the inner wall of the tube and therefore, if appropriate, of transmitting relatively high driving forces to the tube, whilst at the same time avoiding local deformations of the latter.

Preferably, the cap-shaped part of the driving element is equipped with a stop collar, with the aid of which the cap is prevented from emerging completely from the basic body of the tube coupling. The receptacles for the driving elements are arranged radially in the basic body and may be designed, if balls are used as driving elements, as a cylindrical bore or, if driving elements are used as a combination of cap-shaped parts and of balls partially surrounded by the caps, as a perforation of virtually any desired cross section, for example a prismatic cross section.

In order to prevent the balls, as sole driving elements, from emerging, the cylindrical bores are designed with an outer spherical narrowing in the basic body.

While, in every embodiment of the invention, a guide slope is arranged on the thrust piece for the purpose of the radial emergence of the driving elements from the basic body, the arrangement of guide slopes for the detaining centrifugal elements located between the thrust piece and the end piece may be restricted, as required, to one guide slope. In this case, the rolling tracks for the detaining centrifugal elements designed as cylindrical rollers or balls have inclinations relative to the horizontal, either on the end piece fixedly anchored to the basic body or on the thrust piece. The fundamental difference between the guide slope for the driving elements and the guide slopes for the detaining centrifugal elements is that the guide slope arranged on the thrust piece for displacing the driving elements is designed such that it widens outward.

By contrast, the guide slopes of the guide tracks for the detaining centrifugal elements are designed so as to widen inward. However, all the guide slopes may have selectable inclinations relative to the horizontal. This makes it possible, in design terms, to satisfy the various requirements arising from the actual rotational speed, the actual thread tension and the type of material of the bobbin tube. The selection of the inclinations of the guide slopes, on the one hand, determines the force action by which the driving elements are pressed against the inner wall of the bobbin tube when the thrust piece is under axial load. On the other hand, the selection of the inclinations of the guide slopes in the tracks for the detaining centrifugal elements determines the force which, under the action of centrifugal force, applies the detaining centrifugal elements to the thrust piece in the axial direction. In a particular embodiment, the selectable angle of the guide slope for the driving elements on the thrust piece is preferably 40° relative to the horizontal.

By contrast, the guide slopes arranged in the guide tracks for the detaining centrifugal elements have a selectable angle, preferably 10° relative to the horizontal. For the uniform guidance of the thrust piece during axial downward displacement by means of the detaining centrifugal elements, it is sufficient if at least three radially arranged guide tracks are formed between the end piece and the thrust piece.

However, in order to increase the action of force on the axially displaceable thrust piece as a result of generally higher overall masses of the detaining centrifugal elements, the number of guide tracks may also be increased.

A further embodiment of the invention provides for the thrust piece to be equipped with a sliding bush ensuring the easy axial displaceability of the thrust piece on the spindle shank.

On account of the relative inaccessibility of the installed tube couplings and, in particular, of this sliding-bush, a plastic bush, for example made of PTFE, is preferably selected for producing the sliding bush.

Overall, the tube coupling is designed in such a way that it contains predominantly individual elements which can be produced in automatic manufacturing steps. In addition, the proposed solution is also distinguished in that the assembly of the developed tube coupling can likewise be carried out in a predominantly automated manner.

For this purpose, for fixing the end piece, the basic body has arranged on it an assembly collar for the fit of the end piece in the basic body.

There is provision, moreover, for producing between the basic body and the end piece a positive connection to be made after the conclusion of the assembly of the tube coupling, for example by means of a deforming pressing operation.

It may be advantageous to arrange between the end piece and the thrust piece a compression spring which ensures the lowest possible position of the thrust piece in each case in the basic body. What is achieved thereby is that, in addition to the inherent mass of the thrust piece, a further force component presses the driving elements against the inner wall of the spindle tube, even with the spindle at a standstill, and consequently ensures that the spindle tube is centered on the spindle shank. This may be important for starting up the spindle, while at the same time avoiding unbalances. Moreover, the defined driving force assists the use of equipping and removing mechanisms on the respective textile machine.

A further particular embodiment of the tube coupling is characterized in that an elastic band is arranged on the outer circumference of the basic body in the plane of passage of the driving elements through said basic body. This band covers the receptacles for the driving elements and leads to the driving elements being retained in the respective initial position when the spindle is at a standstill. In this case, the radial force on the driving elements, which is caused by the thrust piece and, if appropriate, by the compression spring used, is overcome, so that it becomes easier for the bobbin tubes to be attached or detached on the respective spindle shank.

For the nonpositive fastening of the individual tube coupling on the spindle shank, threaded bores are arranged on the basic body. In order to avoid unbalances, at least two opposite bores with corresponding locking screws are used preferably for each tube coupling.

It is normally sufficient if one clamping piece and at least one of the proposed tube couplings are arranged for the defined fixing of the bobbin tube on the respective spindle shank.

If relatively long bobbin tubes are used or if bobbin tubes which could experience pronounced deformation as a result of high thread tensions are employed, two or more tube couplings may also be arranged for the nonpositive and centric fixing of the respective bobbin tube on the spindle shank.

The advantages of the proposed technical solution are, in summary, that a tube coupling is now available by means of which the defects of the known prior art are reliably overcome. As a result of it being formed from individual elements which can easily be produced, the tube coupling can be manufactured efficiently. It ensures, in particular, that the respective spindle shank can be equipped and stripped without obstruction, this being conducive to the use of appropriate mechanisms on the respective textile machine. Due to the variable use of the tube coupling, the latter can be employed not only for the widest possible variety of materials of the bobbin tube used, but also for the widest possible diversity of geometries of the bobbin tubes and for any desired thread tensions. A decisive advantage, at the same time, is that the play between the inside diameter of the bobbin tube and the outside diameter of the tube coupling may, in practice, be selected within a wide range, without eccentricities and consequently, in particular, unbalances exerting mechanical load having to be taken into account at the same time during the running of the spindle.

According to an aspect of the present invention, a play-free and centering tube coupling for nonpositively connecting a tube receptacle to a spindle shank of a textile machine includes a body, a thrust piece arranged axially moveably within the body, and an end piece fixedly connected to the body. The thrust piece has at least one face and the end piece has at least one face. At least three driving elements are arranged centrically and adapted to bear against an inner wall of the tube receptacle. The driving elements are arranged so as to be movable predominantly radially between the body and the thrust piece. Guide slope in the form of a conical collar arranged on the thrust piece is arranged to contact the at least three driving elements, and detaining centrifugal elements are positioned between the thrust piece and the end piece and are displaceable predominantly in a radial direction. At least one of the at least one faces of the thrust piece and of the end piece is arranged as an additional guide slope positioned to contact the detaining centrifugal elements.

According to another aspect of the present invention, there is a difference in dimension between an outer radius of the body and an outer radius of a middle cylindrical part of the thrust piece has at least a size of a diameter of a spherical driving element.

Additionally, other aspects of the present invention are provided including driving element further having a cap-shaped part attached to the body, and a difference in dimension between an outer radius of the body and an outer radius of a middle cylindrical part of the thrust piece has at least the size of an overall dimension of a spherical part of the driving element including an attached cap-shaped part of the driving element.

In another aspect of the present invention, the at least three driving elements are one of spherical elements and caps with inner balls. According to a further aspect of the present invention the caps are equipped with a stop collar. In another aspect of the present invention the body contains receiving receptacles arranged in a radial configuration to receive the at least three driving elements.

According to a further aspect of the present invention, the receiving receptacles comprise one of cylindrical bores as a prismatic perforation and cylindrical bores with an outer spherical narrowing. According to a still further aspect of the present invention, each at least one face of the thrust piece and each at least one face of the end piece are positioned to form additional guide slopes arranged to retain the centrifugal detaining elements, and wherein the guide slope and the additional guide slopes have selectable inclinations relative to a horizontal plane.

According to a further aspect of the present invention, the guide slope for the at least three driving elements on the thrust piece has a selectable angle. In another aspect of the present invention, the guide slope of the thrust piece has an angle of 40° relative to the horizontal plane. According to a still further aspect of the present invention the at least one face of the end piece is arranged as an additional guide slope, and the guide slope of the thrust piece and the additional guide slope each have a selectable angle.

Further aspects of the invention include the guide slope of the thrust piece and the additional guide slope each having an angle of 10° relative to a horizontal plane. According to other aspects of the present invention the detaining centrifugal elements are one of (1) spherical rollers and (2) cylindrical rollers positionable to fix the thrust piece in a working position.

Further aspects of the invention include at least three radially arranged guide tracks formed between said thrust piece and said end piece for said detaining centrifugal elements arranged between said end piece and said thrust piece. According to another aspect of the present invention the thrust piece is equipped with a sliding bush positioned to ensure axial displaceability of said thrust piece on the spindle shank.

According to a further aspect of the present invention, the body further comprises an assembly collar for fixing the end piece in the body. According to a still further aspect of the invention, a positive connection to be made after conclusion of assembly of the tube coupling is produced between the body and the end piece.

According to an aspect of the present invention, a compression spring ensuring a lowest possible position of the thrust piece in the body is arranged between the end piece and the thrust piece. According to another aspect of the present invention, an elastic band is arranged on an outer circumference of the body to cover the receiving receptacles, whereby the driving elements are retained in an initial position when the spindle shank is at a standstill.

In another aspect of the present invention, the body further includes threaded bores for nonpositively fixing the tube coupling on the spindle shank. According to a further aspect of the present invention, in combination with a spindle shank, and a tube receptacle, at least one clamping piece and at least one tube coupling is arranged for a nonpositive and centric fixing of the tube receptacle on the spindle shank. According to a further aspect of the present invention, in combination with a spindle shank, and a tube receptacle, at least two tube couplings are arranged for a nonpositive and centric fixing of the tube receptacle on the spindle shank.

In another aspect of the present invention, a play-free and centering tube coupling adapted for nonpositively connecting a tube receptacle to a spindle shank of a textile machine includes a cylindrical body having a first axial bore, a cylindrical thrust piece having a second axial bore, the thrust piece being concentrically located and axially moveable within the body, and a cylindrical end piece having a third axial bore, the end piece being fixedly connected to the body. At least three driving elements being circumferentially arranged and radially spaced within the body so as to bear against an inner wall of the tube receptacle. The at least three driving elements are configured to be movable predominantly in a radial direction between the body and the thrust piece. Guide slope in the form of a conically shaped collar is arranged on the thrust piece and is in contact with the at least three driving elements. Detaining centrifugal elements displaceable predominantly in a radial direction arranged between the thrust piece and the end piece.

Other exemplary embodiments and advantages of the present invention may be ascertained by reviewing the present disclosure and the accompanying drawing.

BRIEF DESCRIPTION OF THE DRAWINGS

The present invention is further described in the detailed description which follows, in reference to the noted plurality of drawings by way of non-limiting examples of exemplary embodiments of the present invention, in which like reference numerals represent similar parts throughout the several views of the drawings, and wherein.

DETAILED DESCRIPTION OF THE PRESENT INVENTION

Figure 1:
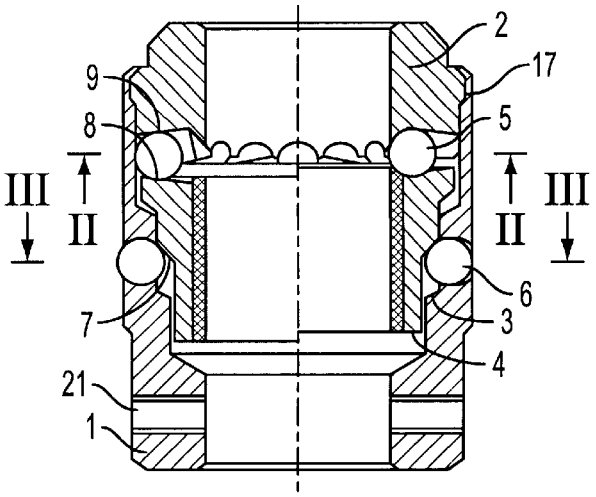
FIG. 1 shows the diagrammatic longitudinal section through a tube coupling in the state of rest and in the working state with twelve spherical detaining centrifugal elements and with seven spherical driving elements.
Figure 2:
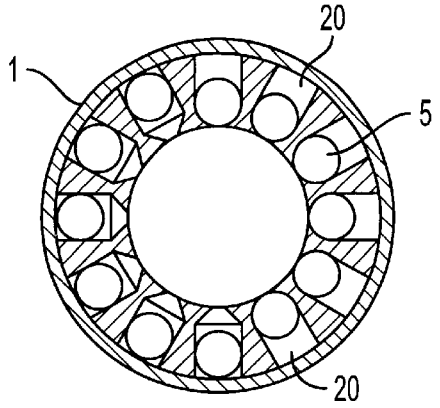
FIG. 2 shows the diagrammatic sectional illustration in the sectional plane II—II of FIG. 1.
Figure 3:
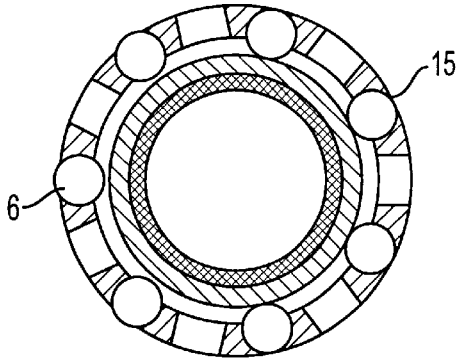
FIG. 3 shows the diagrammatic sectional illustration 5 in the sectional plane III—III of FIG. 1.

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

Exemplary Embodiment 1

According to FIGS. 1 to 3 and FIG. 6, a tube coupling includes a basic body 1, an end piece 2 and a thrust piece 3. A sliding bush 4 is arranged in the thrust piece 3 in such a way that said sliding bush ensures a sliding and positive connection to the spindle shank 10. The basic body 1 is equipped with two threaded bores 21, with the aid of which the nonpositive fixing of the tube coupling to the spindle shank is ensured by the use of headless screws. The basic body 1 possesses seven receptacles 15 for the spherical driving elements 6. These receptacles 15 are designed as cylindrical bores with outer spherical narrowings. After the driving elements 6 have been inserted into the receptacles 15, the thrust piece 3 is introduced into the basic body 1 in such a way that the guide slope 7 designed as a conical collar on the thrust piece 3 is in contact with the driving elements 6. The upper end of the thrust piece 3 contains 12 guide tracks 20 which are designed as a guide slope 8 for the spherical detaining centrifugal elements 5. The sliding bush 4 is led to a height such that it functions as an inner stop for the detaining centrifugal elements 5 inserted.

During the assembly of the tube coupling, after the detaining centrifugal elements 5 have been inserted, the end piece 2 is attached, the latter likewise having twelve guide tracks 20 with the corresponding guide slope 9. The end piece 2 sits on the assembly collar 17 of the basic body 1 and, when assembly is concluded, is fixed nonpositively to the basic body 1 by means of the positive connection 10.

In addition to the clamping piece 12, overall two tube couplings are arranged on the spindle shank 10 in such a way that the bobbin tube 11 is supported at the lower end by the clamping piece 12 and both centrally and at the upper end by one tube coupling in each case.

Along with the vertical attachment and fixing of the tube coupling on the spindle shank 10, the driving elements 6 are displaced radially outward into the receptacles 15 for the driving elements 6 in the basic body 1 under the action of the gravitational force of the movable thrust piece 3 by means of the guide slope 7 which is designed with an inclination of about 40° relative to the horizontal. At the same time, the driving elements 6 emerge from the circumference of the basic body 1 and have to be pressed into the basic body 1 when the bobbin tube 11 is attached. On account of the positive guidance of the thrust piece 3 on the spindle shank 10, the bobbin tube 11 is reliably centered automatically relative to the axis of the spindle shank 10 even when the spindle is at a standstill. The guide slopes 8 and 9 for the detaining centrifugal elements 5 in the guide tracks 20 on the thrust piece and on the end piece 2 have inclinations of about 10° relative to the horizontal. The guide slope 8 for the detaining centrifugal elements 5 on the thrust piece 3 is designed in such a way that, in the state of rest, the detaining centrifugal elements 5 in the guide track 20 assume the position nearest to the spindle axis. Consequently, the thrust piece 3 may, if required, be displaced upward toward the end piece 2. In the working state, this is no longer possible, since the detaining centrifugal elements 5 are thrown outward in the respective guide track 20 and consequently not only prevent the thrust piece 3 from being displaced toward the end piece 2, but at the same time exert a downwardly directed axial force on the thrust piece 3. This gives rise to an additional radial force component on the driving elements 6 and consequently to the reliable nonpositive connection between the tube coupling and bobbin tube 11.

Exemplary Embodiment 2

Figure 4:
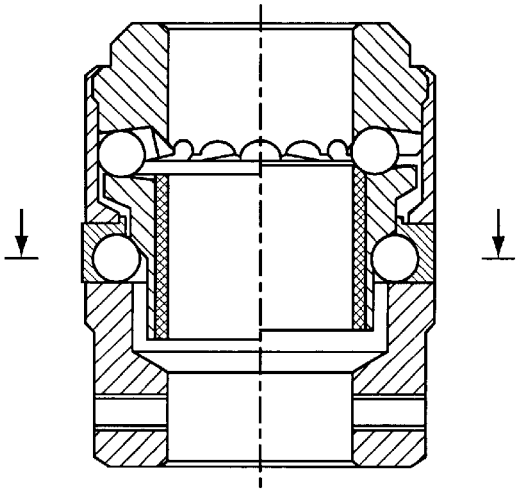
FIG. 4 shows the diagrammatic longitudinal section through a tube coupling in the state of rest and in the working state with twelve spherical detaining centrifugal elements and with eight driving elements, in each case consisting of cap-shaped and spherical parts of the respective driving element.
Figure 5:
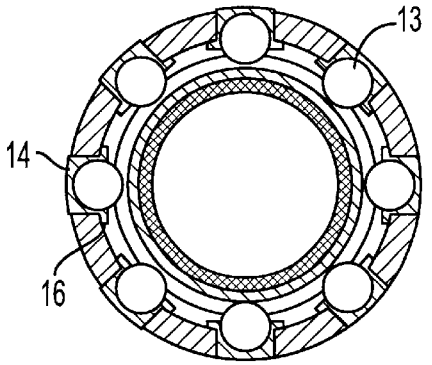
FIG. 5 shows the diagrammatic sectional illustration in the sectional plane V—V of FIG. 4.
Figure 6:
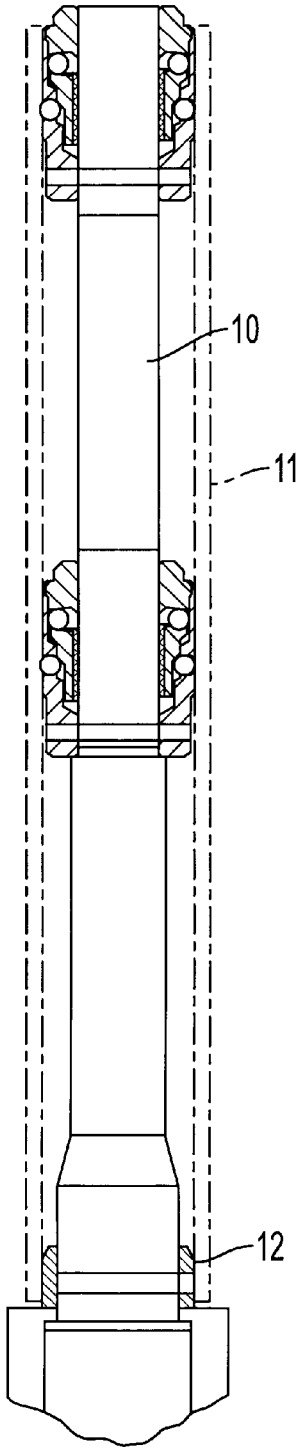
FIG. 6 shows the diagrammatic longitudinal section through a spindle shank with an attached clamping piece and, overall, two tube couplings arranged in an offset manner.

According to FIGS. 4 and 5, a tube coupling includes the individual components mentioned in Example 1. However, instead of seven spherical driving elements 6, overall eight cylindrical receptacles 15 are formed in the basic 1, the cap-shaped parts 14 of the driving elements 6 being located displaceably in said receptacles. Spherical parts 13 of the driving elements 6 are embedded in these cap-shaped parts 14 and are themselves connected to the guide slope 7 for the driving elements 6 on the thrust piece 3.

The cap-shaped parts 14 of the driving elements 6 possess in each case a stop collar 16 which prevents the driving element 6 from emerging completely from the basic body 1. This embodiment of the driving elements 6 is used preferably for bobbin tubes 11 which make it necessary for the driving elements 6 to engage over an area on the inner wall of the bobbin tube 11 in order to prevent local deformations.

Exemplary Embodiment 3

Figure 7:
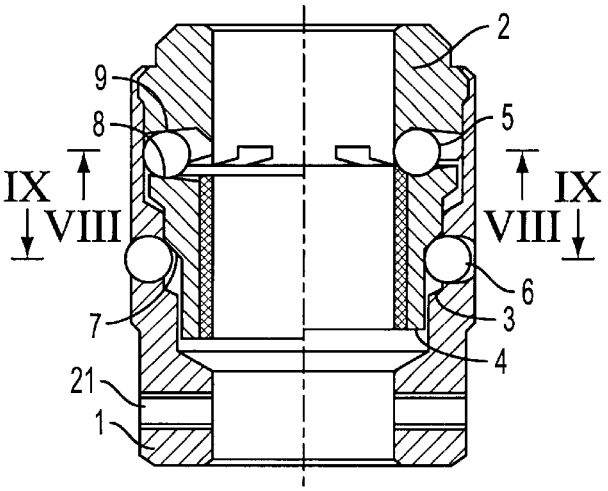
FIG. 7 shows the diagrammatic longitudinal section through a tube coupling in the state of rest and in the working state with six roller-shaped detaining centrifugal elements and with seven spherical driving elements.
Figure 8:
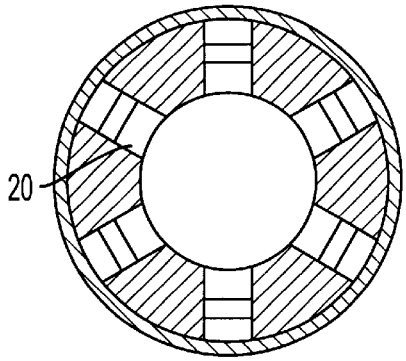
FIG. 8 shows the diagrammatic sectional illustration in the sectional plane VIII—VIII of FIG. 7.
Figure 9:
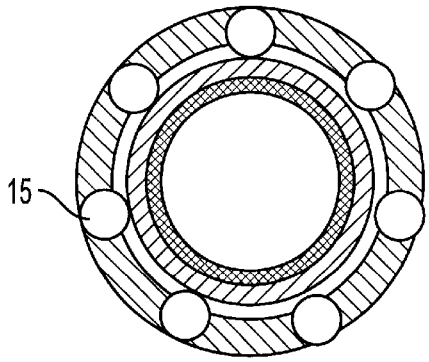
FIG. 9 shows the diagrammatic sectional illustration in the sectional plane IX—IX of FIG. 7.

According to FIGS. 7 to 9, a tube coupling is designed in a similar way to exemplary embodiment 1. In this case, however, the six guide tracks 20 for the detaining centrifugal elements 5 are of prismatic design, the detaining centrifugal elements 5 themselves being used as cylindrical rollers.

Exemplary Embodiment 4

Figure 10:
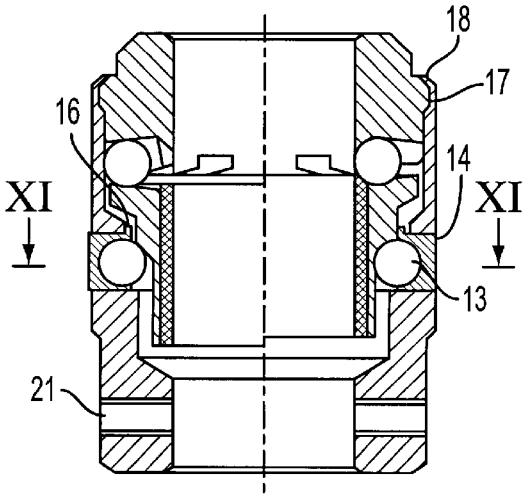
FIG. 10 shows the diagrammatic longitudinal section through a tube coupling in the state of rest and in the working state with six roller-shaped detaining centrifugal elements and with eight driving elements, in each case consisting of cap-shaped and spherical parts of the respective driving element.
Figure 11:
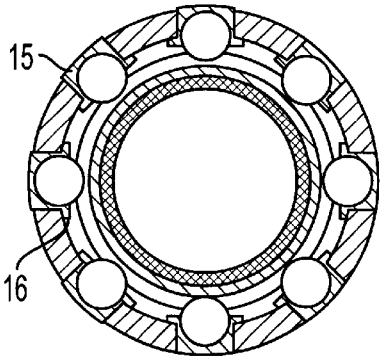
FIG. 11 shows the diagrammatic sectional illustration in the sectional plane XI—XI of FIG. 10.

According to FIGS. 10 and 11, the tube coupling is modified, as compared with the embodiment in Example 3, to the effect that the driving elements 6 are designed in the same way as in exemplary embodiment 2.

Exemplary Embodiment 5

Figure 12:
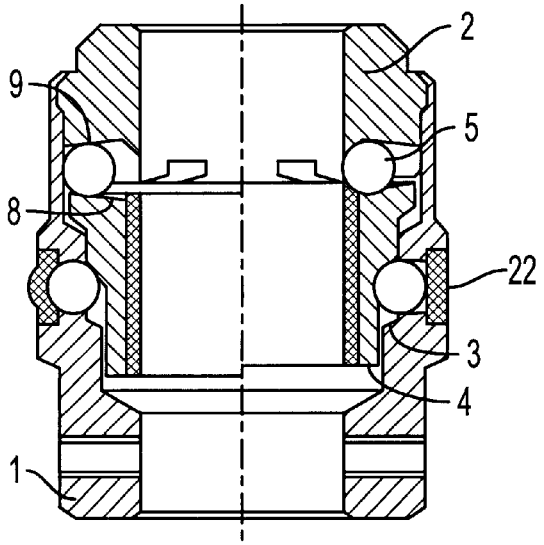
FIG. 12 shows the diagrammatic longitudinal section through a tube coupling in the state of rest and in the working state with six roller-shaped detaining centrifugal elements and with four spherical driving elements which are covered by an elastic band on the circumference of the basic body.

According to FIG. 12, a tube coupling is designed in a fundamentally similar way to the tube coupling designed in exemplary embodiment 1. In this example, however, only four spherical driving elements 6 are provided, the receptacles 15 for the driving elements 6 in the basic body 1 being covered by an elastic band 22 inserted into the periphery of the basic body 1. This embodiment of the tube coupling is employed preferably when, on the one hand, the engagement of the driving elements 6 into the bobbin tube 11 is to be canceled when the spindle is at a standstill and, on the other hand, a careful application of force is to be achieved by the hand material being interposed between the driving element 6 and bobbin tube 11.

Exemplary Embodiment 6

Figure 13:
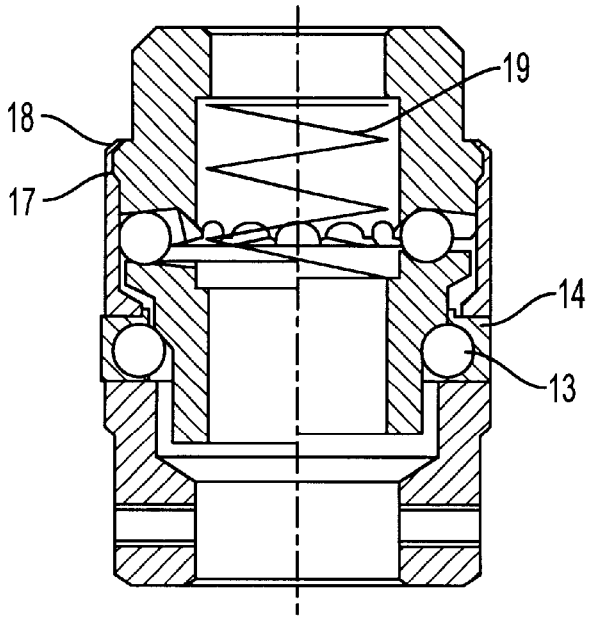
FIG. 13 shows the diagrammatic longitudinal section through a tube coupling in the state of rest and in the working state with twelve spherical detaining centrifugal elements and with four driving elements, in each case consisting of cap-shaped and spherical parts of the respective driving element, supplemented by a compression spring between the thrust piece and end piece.

According to FIG. 13, the tube coupling described in exemplary embodiment 2 is modified in such a way that both the end piece 2 and the thrust piece 3 have an additional stop collar in each case, a compression spring 19 being arranged between said stop collars. This compression spring 19 ensures, even when the spindle is at a standstill, that the axial force exerted on the thrust piece 3 is such that the driving elements 6 provides a reliable centering action, on the one hand, and a sufficient nonpositive connection between the tube coupling and bobbin tube 11 when the spindle is started up, on the other hand, are brought about by means of said force, but easy attachment and drawing-off of the sleeve are still possible.

It is noted that the foregoing examples have been provided merely for the purpose of explanation and are in no way to be construed as limiting of the present invention. While the present invention has been described with reference to an exemplary embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

LIST OF REFERENCE SYMBOLS

1 Basic body
2 End piece
3 Thrust piece
4 Sliding bush
5 Detaining centrifugal elements
6 Driving elements
7 Guide slope for the driving elements on the thrust piece
8 Guide slope for the detaining centrifugal elements on the thrust piece
9 Guide slope for the detaining centrifugal elements on the end piece
10 Spindle shank
11 Bobbin tube
12 Clamping piece
13 spherical part of the driving element
14 Cap-shaped part of the driving element
15 Receptacle for the driving elements in the basic body
16 Stop collar on the cap-shaped driving element
17 Assembly collar for the fit of the end piece in the basic body
18 Positive connection
19 Compression spring
20 Guide tracks
21 Threaded bore
22 Elastic band

What is claimed is:

1. A play-free and centering tube coupling for nonpositively connecting a tube receptacle to a spindle shank of a textile machine, said tube coupling comprising:

a body;

a thrust piece arranged axially moveably within said body, said thrust piece having at least one face;

an end piece fixedly connected to said body, said end piece having at least one face;

at least three driving elements being arranged centrically and adapted to bear against an inner wall of the tube receptacle, wherein said driving elements are arranged so as to be movable predominantly radially between said body and said thrust piece;

a guide slope in the form of a conical collar arranged on said thrust piece being arranged to contact said at least three driving elements; and detaining centrifugal elements being positioned between said thrust piece and said end piece and being displaceable predominantly in a radial direction, wherein at least one of said at least one faces of said thrust piece and of said end piece is arranged as an additional guide slope positioned to contact said detaining centrifugal elements.

2. The tube coupling according to claim 1, wherein a difference in dimension between an outer radius of said body and an outer radius of a middle cylindrical part of said thrust piece has at least a size of a diameter of a spherical driving element.

3. The tube coupling according to claim 1, wherein said driving elements further comprise cap-shaped parts attached to said body, and wherein a difference in dimension between an outer radius of said body and an outer radius of a middle cylindrical part of said thrust piece has at least the size of an overall dimension of a spherical part of one of said driving elements including said attached cap-shaped part of said one driving element.

4. The tube coupling according to claim 1, wherein said at least three driving elements are one of spherical elements and caps with inner balls.

5. The tube coupling according to claim 4, wherein said caps are equipped with a stop collar.

6. The tube coupling according to claim 1, wherein said body contains receiving receptacles arranged in a radial configuration to receive said at least three driving elements.

7. The tube coupling according to claim 6, wherein said receiving receptacles comprise one of cylindrical bores as a prismatic perforation and cylindrical bores with an outer spherical narrowing.

8. The tube coupling according to claim 6, wherein an elastic band is arranged on an outer circumference of said body to cover said receiving receptacles, whereby said driving elements are retained in an initial position when the spindle shank is at a standstill.

9. The tube coupling according to claim 1, wherein each at least one face of said thrust piece and each at least one face of said end piece are positioned to form additional guide slopes arranged to retain said centrifugal detaining elements, and wherein said guide slope and said additional guide slopes have selectable inclinations relative to a horizontal plane.

10. The tube coupling according to claim 9, wherein the guide slope for said at least three driving elements on said thrust piece has a selectable angle.

11. The tube coupling according to claim 10, wherein the guide slope of said thrust piece has an angle of 40° relative to the horizontal plane.

12. The tube coupling according to claim 1, wherein the at least one face of said end piece is arranged as an additional guide slope, and the guide slope of said thrust piece and said additional guide slope each have a selectable angle.

13. The tube coupling according to claim 12, wherein the guide slope of thrust piece and said additional guide slope each have an angle of 10° relative to a horizontal plane.

14. The tube coupling according to claim 1, wherein said detaining centrifugal elements are one of (1) spherical rollers and (2) cylindrical rollers positionable to fix said thrust piece in a working position.

15. The tube coupling according to claim 1, wherein at least three radially arranged guide tracks are formed between said thrust piece and said end piece for said detaining centrifugal elements arranged between said end piece and said thrust piece.

16. The tube coupling according to claim 1, wherein said thrust piece is equipped with a sliding bush positioned to ensure axial displaceability of said thrust piece on the spindle shank.

17. The tube coupling according to claim 1, wherein said body further comprises an assembly collar for fixing said end piece in said body.

18. The tube coupling according to claim 1, further comprising a connector element structured and arranged between the said body and said end piece to produce a positive connection after conclusion of assembly of the tube coupling.

19. The tube coupling according to claim 1, further comprising a compression spring ensuring a lowest possible position of said thrust piece in said body is arranged between said end piece and said thrust piece.

20. The tube coupling according to claim 1, said body further comprising threaded bores for nonpositively fixing said tube coupling on the spindle shank.

21. The tube coupling according to claim 1, in combination with a spindle shank, and a tube receptacle, wherein at least one clamping piece and at least one tube coupling is arranged for a nonpositive and centric fixing of said tube receptacle on said spindle shank.

22. The tube coupling according to claim 1, in combination with a spindle shank, and a tube receptacle, wherein at least two tube couplings are arranged for a nonpositive and centric fixing of said tube receptacle on said spindle shank.

23. A play-free and centering tube coupling adapted for nonpositively connecting a tube receptacle to a spindle shank of a textile machine, said tube coupling comprising:

a cylindrical body having a first axial bore;

a cylindrical thrust piece having a second axial bore, said thrust piece concentrically located and axially moveable within said body;

a cylindrical end piece having a third axial bore, said end piece fixedly connected to said body;

at least three driving elements circumferentially arranged and radially spaced within said body so as to bear against an inner wall of said tube receptacle, wherein said at least three driving elements are configured to be movable predominantly in a radial direction between said body and said thrust piece;

a guide slope in the form of a conically shaped collar arranged on said thrust piece and in contact with said at least three driving elements; and detaining centrifugal elements displaceable predominantly in a radial direction arranged between said thrust piece and said end piece.

* * * * *